US009446276B2

(12) United States Patent
Araujo

(10) Patent No.: US 9,446,276 B2
(45) Date of Patent: Sep. 20, 2016

(54) EXERCISE APPARATUS FOR STRENGTHENING ABDOMINAL MUSCLES

(71) Applicant: William Araujo, Edison, NJ (US)

(72) Inventor: William Araujo, Edison, NJ (US)

( * ) Notice: Subject to any disclaimer, the term of this patent is extended or adjusted under 35 U.S.C. 154(b) by 22 days.

(21) Appl. No.: 14/685,825

(22) Filed: Apr. 14, 2015

(65) Prior Publication Data

US 2015/0231439 A1 Aug. 20, 2015

Related U.S. Application Data

(63) Continuation of application No. 12/880,156, filed on Sep. 13, 2010, now Pat. No. 9,017,237, which is an application for the reissue of Pat. No. 7,803,097.

(60) Provisional application No. 60/743,087, filed on Jan. 1, 2006.

(51) Int. Cl.

| | |
|---|---|
| ***A63B 26/00*** | (2006.01) |
| ***A63B 21/00*** | (2006.01) |
| ***A63B 21/045*** | (2006.01) |
| ***A63B 23/02*** | (2006.01) |

(52) U.S. Cl.

CPC ..... *A63B 21/00181* (2013.01); *A63B 21/045* (2013.01); *A63B 21/1457* (2013.01); *A63B 21/1492* (2013.01); *A63B 23/0205* (2013.01); *A63B 23/0211* (2013.01); *A63B 2210/50* (2013.01)

(58) Field of Classification Search

USPC ..... 482/93, 121, 122, 123, 129, 130, 133, 482/140, 142, 907, 908; 5/633, 634, 642; 297/161, 354.12

See application file for complete search history.

(56) References Cited

U.S. PATENT DOCUMENTS

| | | | | |
|---|---|---|---|---|
| 5,352,173 | A * | 10/1994 | McLaughlin | 482/123 |
| 6,053,851 | A * | 4/2000 | Tu | 482/122 |
| 6,716,144 | B1 | 4/2004 | Shifferaw | |
| 7,137,933 | B2 | 11/2006 | Shifferaw | |
| 7,175,567 | B2 * | 2/2007 | Barbafieri et al. | 482/31 |
| 7,803,097 | B2 | 9/2010 | Araujo | |
| 2011/0015048 | A1 | 1/2011 | Araujo | |

* cited by examiner

*Primary Examiner* — Oren Ginsberg
(74) *Attorney, Agent, or Firm* — Stanley H. Kremen

(57) ABSTRACT

An exercise apparatus that lies flat on the floor having a back rest rises up when supported by two springs. The lower part of the back and buttocks lie horizontal while the upper part of the back is inclined at an angle to the horizontal. When not in use, the upper back rest folds down flat so that the device can be stored under a bed. The two springs provide back support when the individual is in the reclining position. However, as a person goes from a sitting position to a reclining position, when his or her shoulders contact the back rest, the springs compress and then expand to assist the individual in rising up. The device has two specially designed positionable foot rests with straps to provide a place for the individual to place his or her feet.

5 Claims, 5 Drawing Sheets

FIG. 4(b)
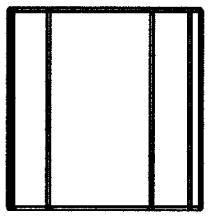
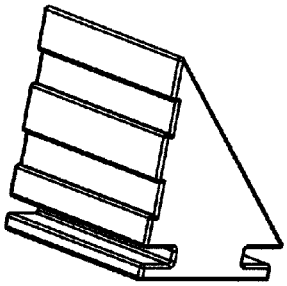
FIG. 4(c)
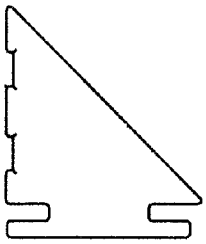
FIG. 4(a)

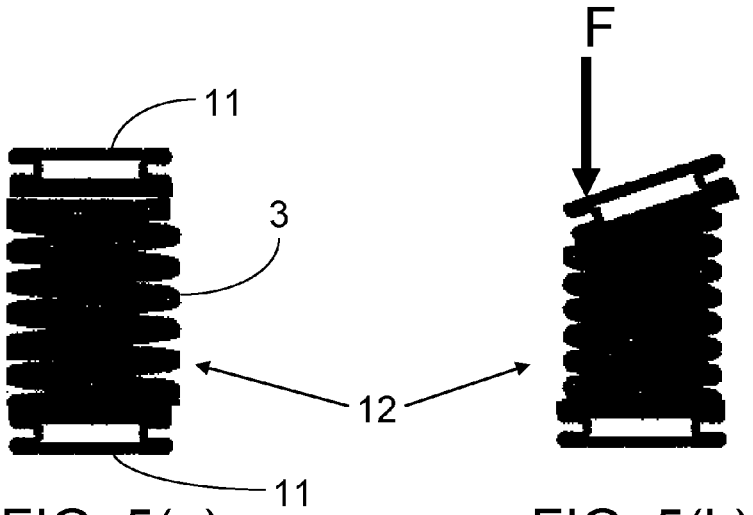
FIG. 5(a) FIG. 5(b)
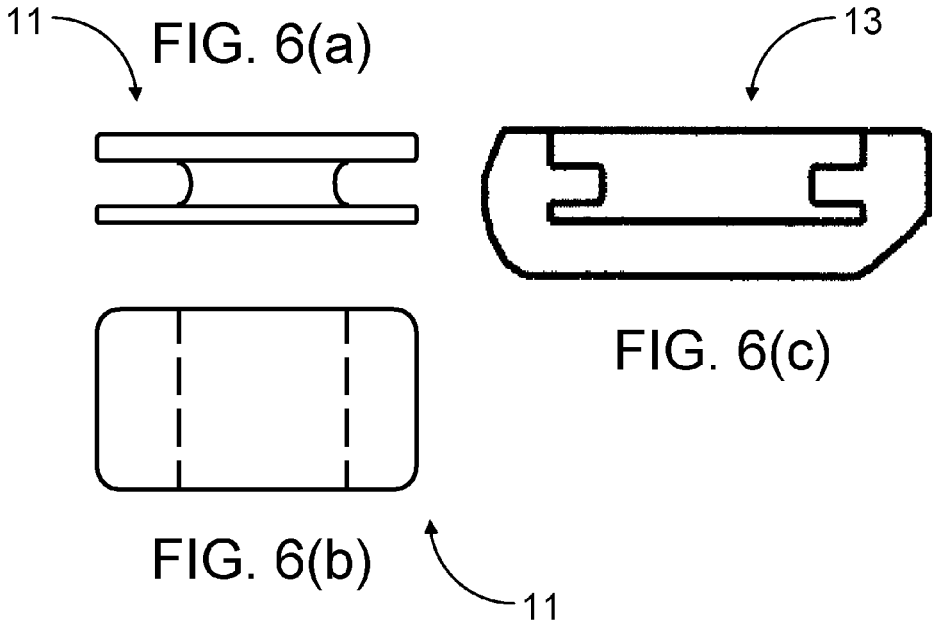
FIG. 6(a)
FIG. 6(c)
FIG. 6(b)

EXERCISE APPARATUS FOR STRENGTHENING ABDOMINAL MUSCLES

CROSS REFERENCE TO RELATED APPLICATIONS

This Present Application is a continuation of U.S. patent application Ser. No. 12/880,156 (the '156 Application) filed on Sep. 13, 2010 (to be issued as U.S. Pat. No. 9,017,237 on Apr. 28, 2015), which in turn is a continuation of U.S. patent application Ser. No. 11/609,977 (the '977 Application) filed on Dec. 13, 2006 (issued as U.S. Pat. No. 7,803,097 on Sep. 28, 2010(, which in turn is the non-provisional counterpart of U.S. Provisional Application Ser. No. 60/743,087 (the '087 Application) filed on Jan. 1, 2006. The Present Application claims the benefit of and priority to the '156 Application, the '977 Application and the '087 Application all three of which are incorporated by reference in their entirety herein.

BACKGROUND OF THE INVENTION

People today are more concerned with physical fitness than ever before. Doctors say that regular exercise is the key to living longer. Over the past few decades, gymnasium membership has skyrocketed. These places have many devices to aid individuals who want to exercise. The devices include treadmills, complex nautilus devices, rowing machines, stationary bicycles, etc. Most of this equipment is very expensive. People, in increasing numbers, are buying much less expensive devices for home use to enable them to keep fit.

The Present Invention is an exercise apparatus designed to aid people in doing sit-ups and stomach crunches. Most people who do these exercises lie on the floor. However, sit-ups performed from this position place undue strain on the neck, upper back, and shoulder muscles. A number of devices are sold commercially to assist people to do the sit-up and stomach crunch exercises. One such device is a canvas and aluminum chair that expands during the lying down part of the cycle, and bends during the sitting up part of the cycle. However this chair does not offer much resistance. So, while using it may feel good because exercising with it is easy, it does not do much to strengthen abdominal muscles. The adage is: "no pain . . . no gain!"

The disadvantages of the devices for this purpose that are currently on the market are:

they do not accommodate heavy or tall people;
they are limited to specific extensions;
they are not comfortable;
they do not offer resistance;
they do not assist in the exercise process.

SUMMARY OF THE INVENTION

The Present Invention is an exercise apparatus that lies flat on the floor. A back rest rises up when supported by two springs. The lower part of the back and buttocks lie horizontal while the upper part of the back is inclined at an angle to the horizontal. The apparatus permits both feet to be fully extended horizontally for maximum effectiveness while performing stomach crunches. When not in use, the upper back rest folds down flat so that the device can be stored under a bed. Because of adjustable extensions, the device can accommodate a person who is anywhere between 4 feet to 7% feet tall and who weighs anywhere between 90 lb. to 500 lb. The two springs provide back support when the individual is in the reclining position. However, as a person goes from a sitting position to a reclining position, when his or her shoulders contact the back rest, the springs compress and then expand to assist the individual in rising up. The device has two specially designed positionable foot rests with straps to provide a place for the individual to place his or her feet.

BRIEF DESCRIPTION OF THE DRAWINGS

FIG. 1(*b*) is a right side plan view of the Present Invention. The device is symmetrical. Therefore, the left side plan view is similar to the right side view.

FIG. 1(*c*) is a front elevational view of the Present Invention.

FIG. 1(*d*) is a rear elevational view of the Present Invention.

FIG. 4(*a*) is a right side plan view of the foot rest.

FIG. 4(*b*) is a top plan view of the foot rest.

FIG. 4(*c*) is a right isometric view of the foot rest.

FIG. 5(*a*) is a front elevational view of the tabbed spring assembly.

FIG. 5(*b*) is a front elevational view of the tabbed spring assembly wherein a force is applied to its top left portion.

FIG. 6(*a*) is a front elevational view of the tab.

FIG. 6(*b*) is a bottom plan view of the tab.

FIG. 6(*c*) is a front elevational view of the slot.

DETAILED DESCRIPTION OF THE INVENTION

Figures 1A, 1B, 1C, 1D:
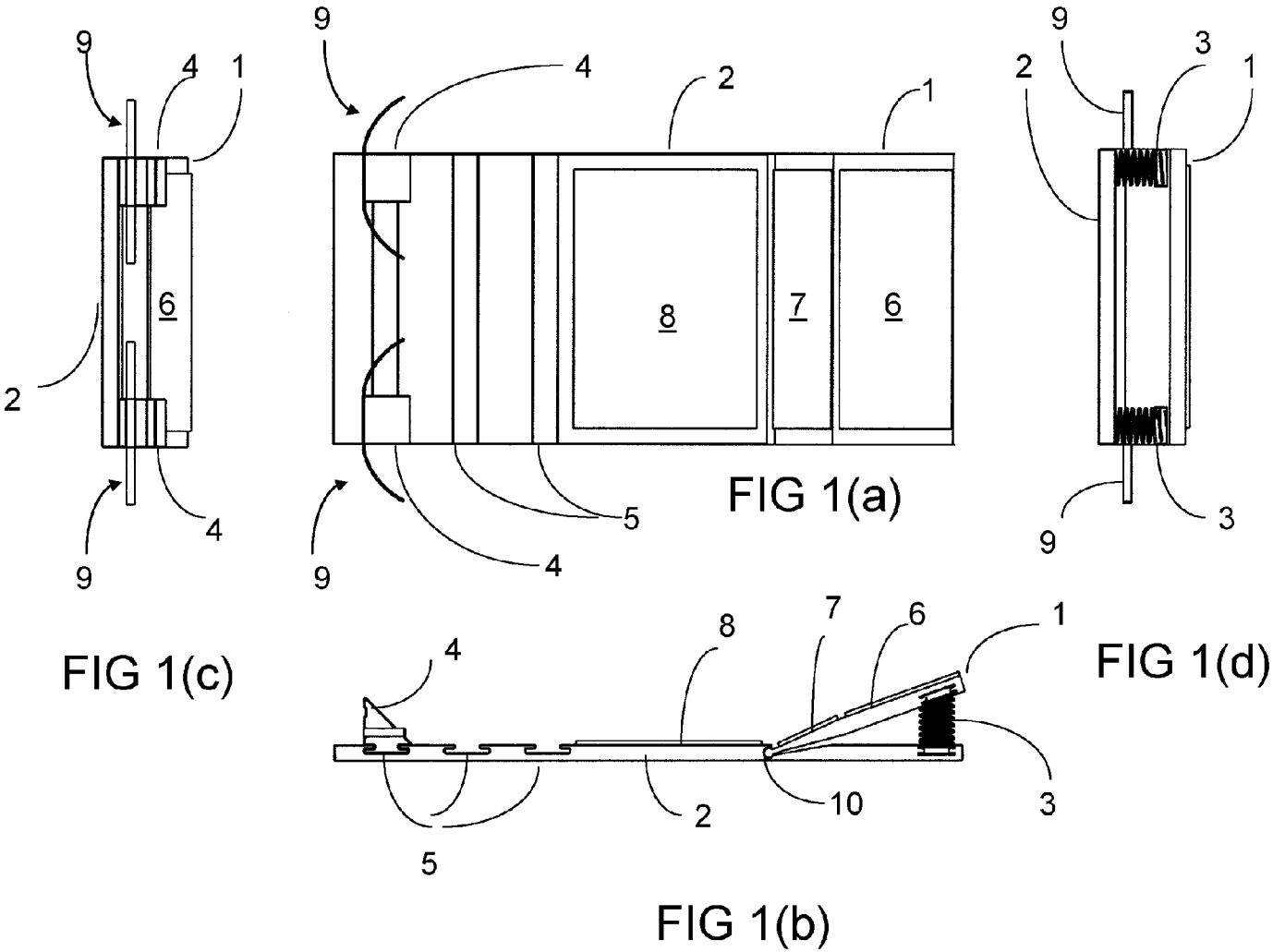
FIG. 1(*a*) is a top elevational view of the Present Invention.

Referring to FIG. 1, the apparatus of the Present Invention comprises a part that lies flat on the ground, 2, and a part that may incline, 1. The part that may incline is the upper back rest. The upper back rest is hinged to the rest of the device at 10. Removable springs 3 allow the upper back rest to remain in the inclined position. Removing the springs 3 permits the device to be stored flat. The device can be made from any durable material, but it is preferably formed from a hard plastic material. The upper back rest 1 would typically have two soft pads, 6 and 7, mounted thereon. Pad 6 supports the upper back, neck, and shoulders while pad 7 supports the middle of the back. Pad 6 should be thicker than pad 7, but this is optional. Pad 6 could also be thicker further toward the back of the device to provide head and neck support. Alternatively a pillow support, where a person can rest his head and neck, can be mounted on pad 6. The horizontal portion 2 has a soft pad 8 mounted thereon in the position shown. Pad 8 supports the lower back and buttocks. Also mounted to the horizontal portion 2 are two foot rests 4 each having strap 9. The foot rests fit adjustably into keyed grooves 5 located on the horizontal portion 2. The foot rests fit into any of the keyed grooves, and they may be moved from side to side. In this way, the foot rests may be adjusted to accommodate a range of leg sizes. Also, a user may work with both legs using both foot rests or, as an alternative, may optionally work with only one leg using only one foot rest.

Figure 2:
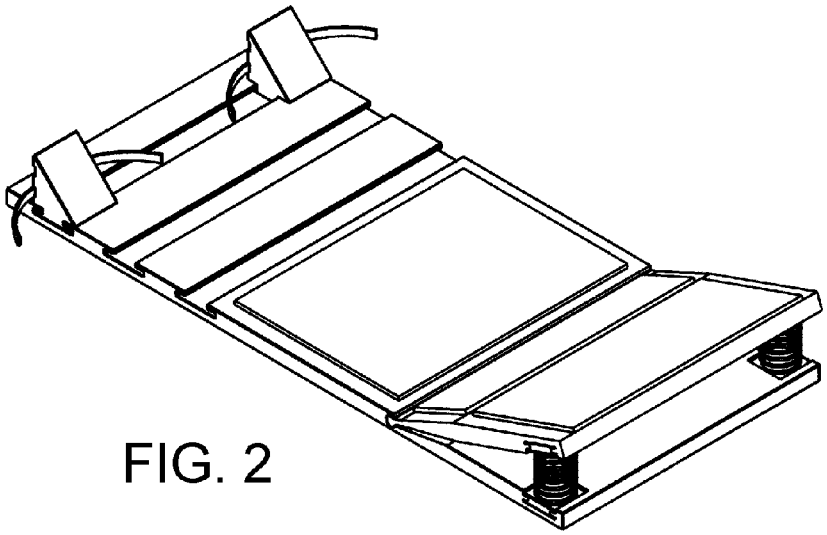
FIG. 2 is a rear isometric view of the Present Invention as seen from the right side.
Figure 3:
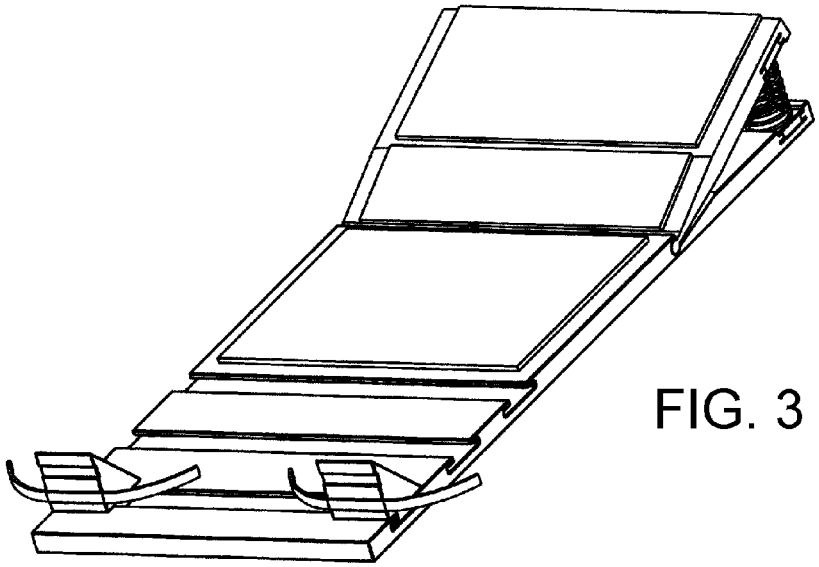
FIG. 3 is a front isometric view of the Present Invention as seen from the right side.

FIG. 2 and FIG. 3 are isometric views of the Present Invention. These views show the structure of the device more clearly. A typical spring would have eight active coils and four inactive coils. Each spring is capable of supporting 100 lbs. Therefore, the back support would be 200 lbs. Even a 500 lb. person would not have an inclined upper back weight exceeding 200 lbs. If fewer coils are used, the spring action is more elastic, and the springs provide greater assistance to the user on the up-cycle. On the other hand, if more coils are used, the spring action is more rigid. Here, the springs provide better back support. It must be noted that although two springs are shown in the figure, the apparatus would work as well with one centrally located spring or, alternatively, more than two springs.

FIGS. 4(*a*), 4(*b*), and 4(*c*) show the foot rest. The foot rest is grooved and has a space or groove wherein a strap can be attached. FIG. 4(*c*) is an isometric view of the foot rest.

FIG. 5(*a*) shows the tabbed spring assembly 12 consisting of a spring 3 and two oppositely oriented tabs 11. FIG. 5(*b*) shows the spring assembly 12 as it compresses under uneven force.

FIG. 6(*a*) shows a front elevation view of the tab 11 used in the tabbed spring assembly 12. FIG. 6(*b*) is a bottom plan view of the plug 11. FIG. 6(*c*) is a front elevation view of the slot that the plug fits into.

Comparison of the Present Invention with Prior Art

A comparison of U.S. Pat. Ser. No. 6,716,144 (issued to Shifferaw on Apr. 6, 2004) and U.S. Pat. Ser. No. 7,137,933 (issued to Shifferaw on Nov. 21, 2006) to the Present Invention demonstrates a significant difference. It is well known that, for maximum effectiveness, stomach crunches should be performed with a person's feet fully extended in the horizontal position. Sit-ups are far more easily performed when a person lies flat with knees bent. As a person's stomach muscles develop, more effective sit-ups are done with unbent knees. With both the Present Invention and the exercise apparatus embodiments taught by Shifferaw, a back rest having resilience assists the user in performing sit-ups. However, in all of Shifferaw's embodiments (in both of his patents), a user must bend his knees. The embodiments taught by Shifferaw are the same in both of his patents. Except for those taught in his FIGS. 5-7 and 10-12, all variations of his invention are raised off the floor by strut supports. In his strut mounted embodiments, a user must bend his knees. Even in the embodiment shown in FIG. 8, which contains a foot rest, the nature of that foot rest requires bending of the knees. The foot rest in FIG. 8 may pivot to accommodate users of various heights. However, this pivoting foot rest requires the user to bend his knees in almost all circumstances.

The Present Invention uses a flat padded part 2 (e.g., a padded board) that lies flat on the ground and a spring supported back rest 1 hinged to the flat board. With the Present Invention, a user may or may not bend his knees ii according to his preference. When a person pushes back on the back rest he performs a reverse sit-up, which is just as effective as an ordinary sit-up. It is important to note that the Present Invention does not use struts to raise the seat off the floor. The use of struts would be superfluous. In fact, struts could cause the device to wobble during exercise if all of the ends do not touch the floor.

Figure 7:
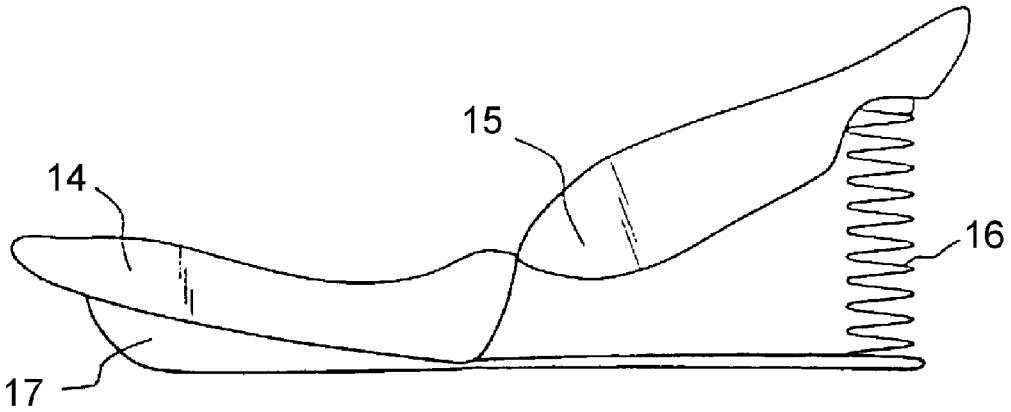
FIG. 7 PRIOR ART
FIG. 7 is a prior art exercise device shown here for comparison with the Present Invention.

The only embodiment of Shifferaw's invention that appears to come close to the Present Invention is shown in Shifferaw's FIG. 11. His embodiment is shown in FIG. 7 of the Present Application. Here, Shifferaw's apparatus (shown in his FIG. 7) sits atop a flat board to afford a unitary construction. In this Shifferaw embodiment, he describes element 14 as a "seat member," element 15 as a "back member," element 16 as an "adjustable resilient means," and element 17 as a "unitary horizontal support." Note that element 17 raises the seat 14 off the floor. Once again, this requires the user to bend his knees during reverse sit-ups.

The Present Invention is distinguished from all of embodiments of Shifferaw's apparatus because the Present Invention allows a user to not bend his knees. This feature affords the user a greater effectiveness in performing stomach crunches. Therefore, the Present Invention demonstrates an unexpected result over Shifferaw.

I claim:

1. An exercise device to assist a person in the performance of abdominal crunches and exercises, wherein said person has buttocks and a back, said exercise device consisting of:

a) a first member that supports the buttocks wherein said first member lays flat on a floor or other essentially planar surface, wherein said first member comprises a top surface having a top length and width, a bottom surface having a bottom length and width, and a plurality of edge surfaces each having a height that is the same on every edge, and further wherein:
- the top surface supports the person's buttocks when he is seated thereon;
- the entire top surface is essentially parallel to the bottom surface;
- all of the plurality of edge surfaces are not parallel to the bottom surface;
- the heights of the plurality of edge surfaces are not parallel to the lengths or widths of the top and bottom surfaces;
- the length of the top surface is approximately equal to the length of the bottom surface;
- the width of the top surface is approximately equal to the width of the bottom surface;
- the lengths of the top and bottom surfaces are substantially larger than the heights of the plurality of edge surfaces; and,
- the entire bottom surface is essentially planar;

such that when the device is laying on an essentially horizontal surface, the person's buttocks rest directly upon the top surface at a height that is essentially not greater than the heights of the plurality of edge surfaces;

b) a second member that supports the person's back, wherein the second member is hinged only to the first member, and further comprises at least one soft support pad;

c) at least one hinge connecting the first member to the second member;

d) at least one removable and replaceable spring having elasticity, which is attached only to said first and second members:
- that when a force is exerted upon the second member by the person sitting or lying on the exercise device, where said force tends to move the second member towards a position parallel to the first member or towards a position on the same plane as the first member, the at least one removable and replaceable spring provides resistance to said force, and
- that when the person is not sitting or lying on the exercise device or does not exert a force, said at least one removable and replaceable spring provides a force that maintains the second member in a position not parallel to the first member and not in the same plane as the first member;

wherein the elasticity of the at least one removable and replaceable spring is selectable so as to provide variable back support.

2. The exercise device of claim 1 wherein the elasticity of the at least one removable and replaceable spring is selected by varying the number of coils.

3. The exercise device of claim 1 wherein the first member is essentially horizontal.

4. The exercise device of claim 1, wherein the number of removable and replaceable springs of the at least one removable and replaceable spring is two.

5. The exercise device of claim 1, wherein the first member is padded with a soft padding material.

* * * * *